US006843381B2

(12) United States Patent
Wu

(10) Patent No.: US 6,843,381 B2
(45) Date of Patent: Jan. 18, 2005

(54) WINE CUP RACK STRUCTURE

(76) Inventor: John Ching Wu, P.O. Box No. 6-57, Chung-Ho, Taipei 235 (TW)

( * ) Notice: Subject to any disclaimer, the term of this patent is extended or adjusted under 35 U.S.C. 154(b) by 0 days.

(21) Appl. No.: 10/378,631

(22) Filed: Mar. 5, 2003

(65) Prior Publication Data

US 2004/0173548 A1 Sep. 9, 2004

(51) Int. Cl.[7] ..... A47F 7/00
(52) U.S. Cl. ..... 211/85.29; 211/94.02; D6/513
(58) Field of Search ..... 211/85.29, 71.01, 211/94.02; 248/311.3, 311.2, 312; D6/513

(56) References Cited

U.S. PATENT DOCUMENTS 3,214,031 A * 10/1965 McCauley
4,228,905 A * 10/1980 Cammarota
4,325,486 A * 4/1982 Neal ..... 211/71.01
D267,914 S * 2/1983 Lin
D275,433 S * 9/1984 Boland
D393,388 S * 4/1998 Chen
6,357,607 B1 * 3/2002 Wu ..... 211/85.29
2002/0185461 A1 * 12/2002 Miller ..... 211/85.29

* cited by examiner

*Primary Examiner*—Robert W. Gibson, Jr.

(57) ABSTRACT

A wine cup rack structure mainly comprises pluralities of horizontal and vertical copper rods, pluralities of column caps forming a frame body. On each side of the lowest two copper rods respectively fix a supporting bar for hangers and a glass plate to be assembled as a whole rack body. There is a dovetail chute with an opening downwards to be installed below the supporting bar for placing hangers; in addition, a glass plate can be placed on the supporting bar. The characteristics lie in that the supporting bar sets on one side of the chute a side plate, which forms a camber surface on the external side for leaning against and fixed with screws on the cylindrical surface of the copper rod; moreover, there is a space in-between the top surface of the chute and the side plate for properly placing a glass plate.

2 Claims, 9 Drawing Sheets

WINE CUP RACK STRUCTURE

BACKGROUND OF THE INVENTION

1) Field of the Invention

The present invention relates to an improvement in wine cup rack structures specifically a copper rod structure having two supporting bars on both sides of the lowest copper rods, respectively. The design of the supporting bars emphasizes on the advantage of being easily assembled on the copper rods and sustaining a glass plate on the top with stability.

2) Description of the Prior Art

Presently known and widely used wine cup rack as shown in FIGS. 6 and 7 is mainly assembled as a frame body by horizontal and vertical copper rods (a), column caps (b) and a glass plate.

Pluralities of pairs of apertures (a1) are perforated on the bottom of the lowest two copper rods (a), on which pluralities of correspondent hangers (e) are established. The hangers (e) are at least one or more U-shaped rods (e1, e2) by pairs. The ends of each pair of U-shaped rods (e1, e2) are bent up on the inward side to be pierced through and fixed into the apertures (a1) on the bottom of both sides of copper rods (a). Pluralities of C-shaped blocks (f) are correspondently installed on the top of the lowest two copper rods (a) and each C-shaped block (f) has a fillister (f1) on the inward side thereof A glass plate (c) is installed in the Fillisters (f1) of pluralities of C-shaped blocks (f) on the upper side of two copper rods (a).

The installation of hangers (e) on this kind of wine cup rack structure firstly requires pluralities of apertures (a1) formed on the bottom of the lowest two copper rods (a) to be perforated at regular intervals. In addition, to achieve the function of, the regular intervals of those apertures (a1) have to be accurately measured for establishing the hangers (e), so that each pair of U-shaped rods (e1, e2) can keep a fixed interval in-between for wine cups to be suspended upside down on the hangers (e), after the installation of those hangers (e).

Therefore, not only the making of this kind of wine cup rack structure requires much time and/or work, but also the perforations have to be accurately measured; otherwise, the U-shaped rods (e1, e2) are unable to be installed on the hangers (e) or wine cups can not be hung upside down on the hangers (e) owing to different intervals among various pairs of U-shaped rods (e1, e2). If so, the wine cup rack fails to perform the functions.

In view of the foregoing drawbacks, a prior invention of an improvement in wine cup rack structure was being designed and registered by the inventor in USA with U.S. Pat. No. 6,357,607B1. The wine cup rack structure is designed for being installed inside a box-shaped wine cellar, but is not suitable for being applied to a cylindrical rack structure. With reference to FIGS. 8 and 9, a frame body is assembled by pluralities of copper rods (5) and pluralities of column caps (50). There are supporting bars (2) to be respectively established on both sides of the lowest two copper rods (5) for matching with hangers (3) and a glass plate (4) to form the whole frame body. The two supporting bars (2) are made by punched metal plate with integrated shape up and have two sets of chutes (21*a*) (21*b*), wherein the chute (21*a*) has an opening inwards; whereas the chute (21*b*) has an opening downwards. The hangers (3) are assembled by at least one or more sets of U-shaped rods (31) by pairs with regular intervals. Bases (32) are set to connect the both ends of the U-shaped rods (31), the lower part of which on the hangers (3) are bent inwards, so that the two bases (32) can be horizontally placed into the chutes (21*b*) of the supporting bars (2); the chute (21*b*) has an opening downwards. The glass plate (4) is horizontally placed into the chute (21*a*) of the supporting bars (2); the chute (21*a*) has an opening inwards.

According to the aforementioned structure assembly, the wine cup rack can be applied to those supporting plates between two wine cellars, in addition, can be hung from the top. The two supporting bars (2) are respectively fixed on the copper rods (5) between the supporting plates of the wine cellars by screws (51); whereas the glass plate (4) is embedded into two horizontal chutes (21*a*). The hangers (3) are placed into the chutes (21*b*) of the bases (32) to enable wine goblets (6) to be suspended by the goblet bases between the U-shaped rods (31).

In spite that said wine cup rack structure can simplify the assembly of presently known wine cup rack, there are still some drawbacks to be improved as follows, 1. As shown in FIGS. 8 and 9 that the glass plate (4) has to be embedded into the chutes (21*a*) between the two supporting bars (2) in advance. Therefore, it is inconvenient for assembling the glass plate (4) into the chutes (21*a*), if the area of the glass plate (4) is bigger with heavier weight, moreover, the surface of the glass plate (4) is easily to generate scratches.
2. The two supporting bars (2) are more suitable to be externally fixed on flat boards. FIG. 9 shows that the two supporting bars (2) are not suitable to be fixed on copper rods (5), as it is easily to loosen and unscrew from both of the upper and lower sides.
3. According to the above, the perforations have to be made in advance if the screws (51) need to pierce through the supporting bars (2) to be fixed on copper rods (5). Therefore, the design of a wine cup rack requires accurate measurement in advance, or it is easily to generate slight differential intervals between holes without guided positioning.

SUMMARY OF THE INVENTION

In view of the foregoing drawbacks, the primary objective of the present invention aims at providing an improved wine cup rack structure focusing on supporting bars based on the existing rack structure, so that the assembly of supporting bars can be more suitable for being fixed on copper rods of a wine cup rack, in addition, the glass plate can be easily installed. The invention puts emphases on the gorgeous appearance after the complete assembly of a wine cup rack, moreover, the stability of the rack.

To achieve the aforementioned effectiveness and objectives, the invention is by dint of the following assembly steps, Two supporting bars are mainly fixed between wine cellars or two copper rods, in addition, there is a dovetail chute, which has a downward opening set below the two supporting bars for hangers to be placed; a glass plate can be put on the top of the supporting bars. A side plate is established on one side of the chute of each supporting bar and forms a camber surface on the external side leaning against the copper rods. The side plate is stably fixed by screws; in addition, a glass plate is placed on the top surface and between the side plates of the supporting bars. Therefore, the invention is more convenient for the assembly, as the glass plate can be directly placed from the top downwards.

To enable a further understanding of the structural features and the technical contents of the present invention, the brief description of the drawings below is followed by the detailed description of the preferred embodiment.

DETAILED DESCRIPTION OF THE PREFERRED EMBODIMENTS

Figure 1:
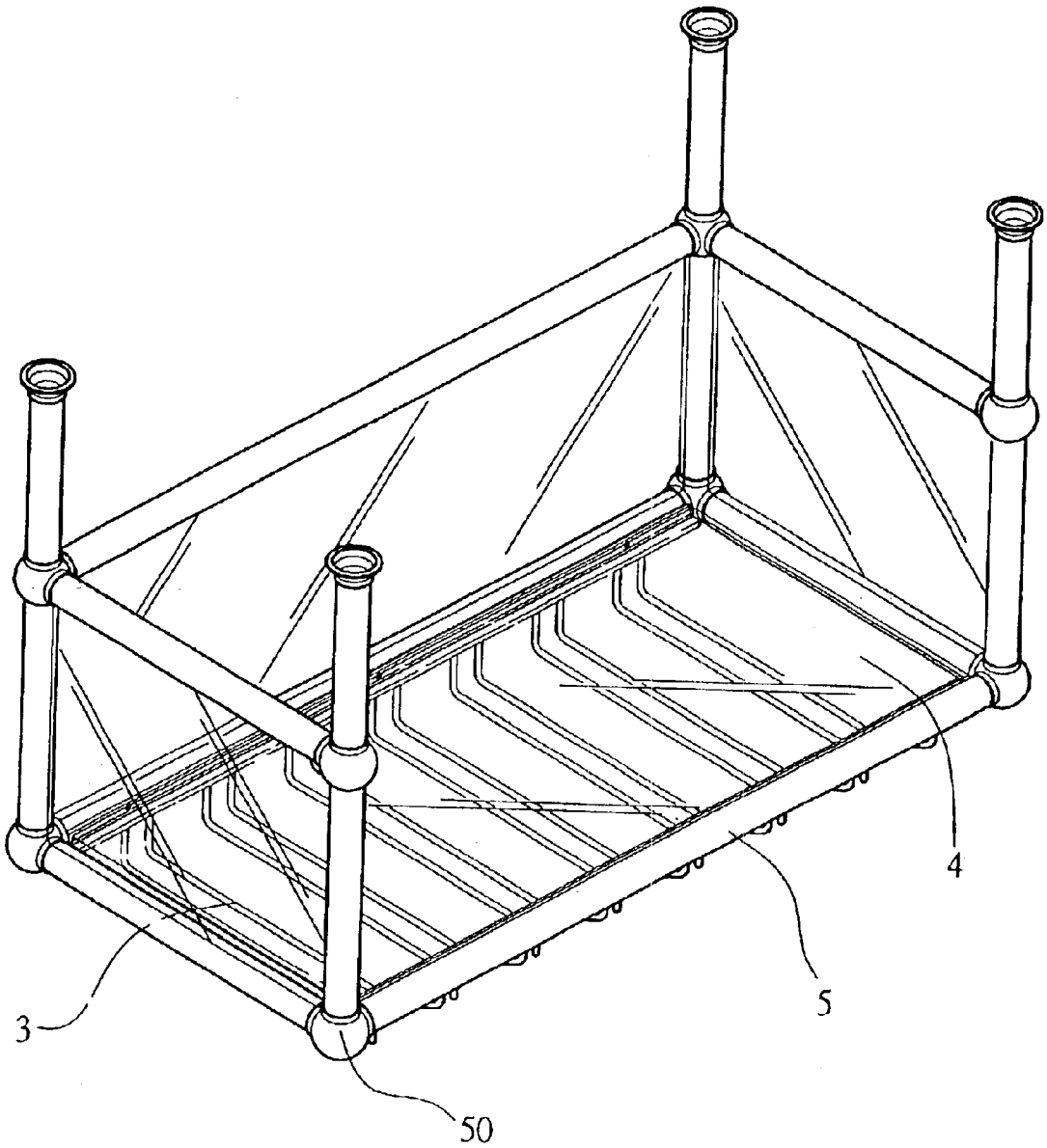
FIG. 1 is a structural drawing of the present invention.
Figure 2:
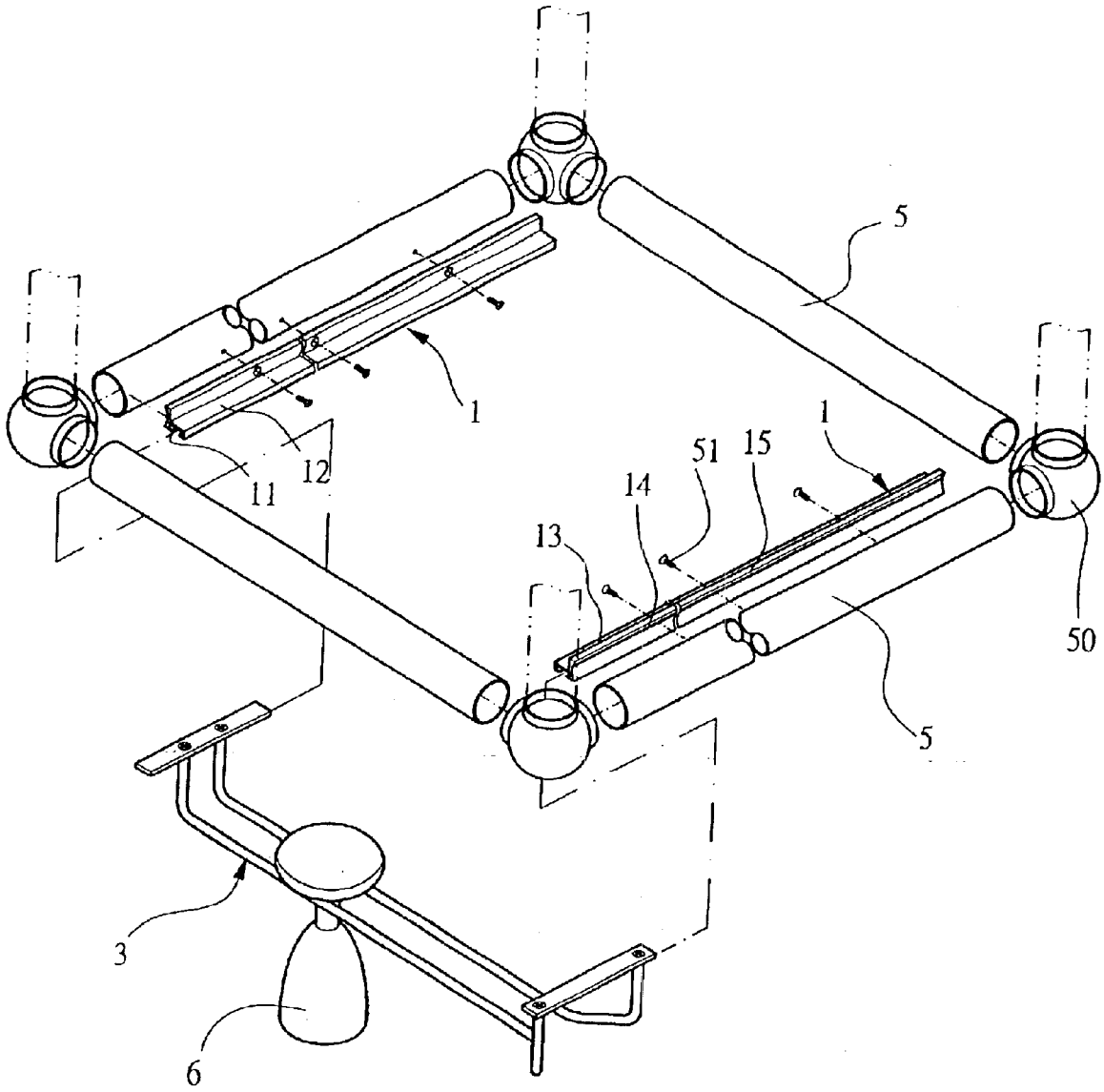
FIG. 2 is a perspective exploded view of the present invention.
Figure 4:
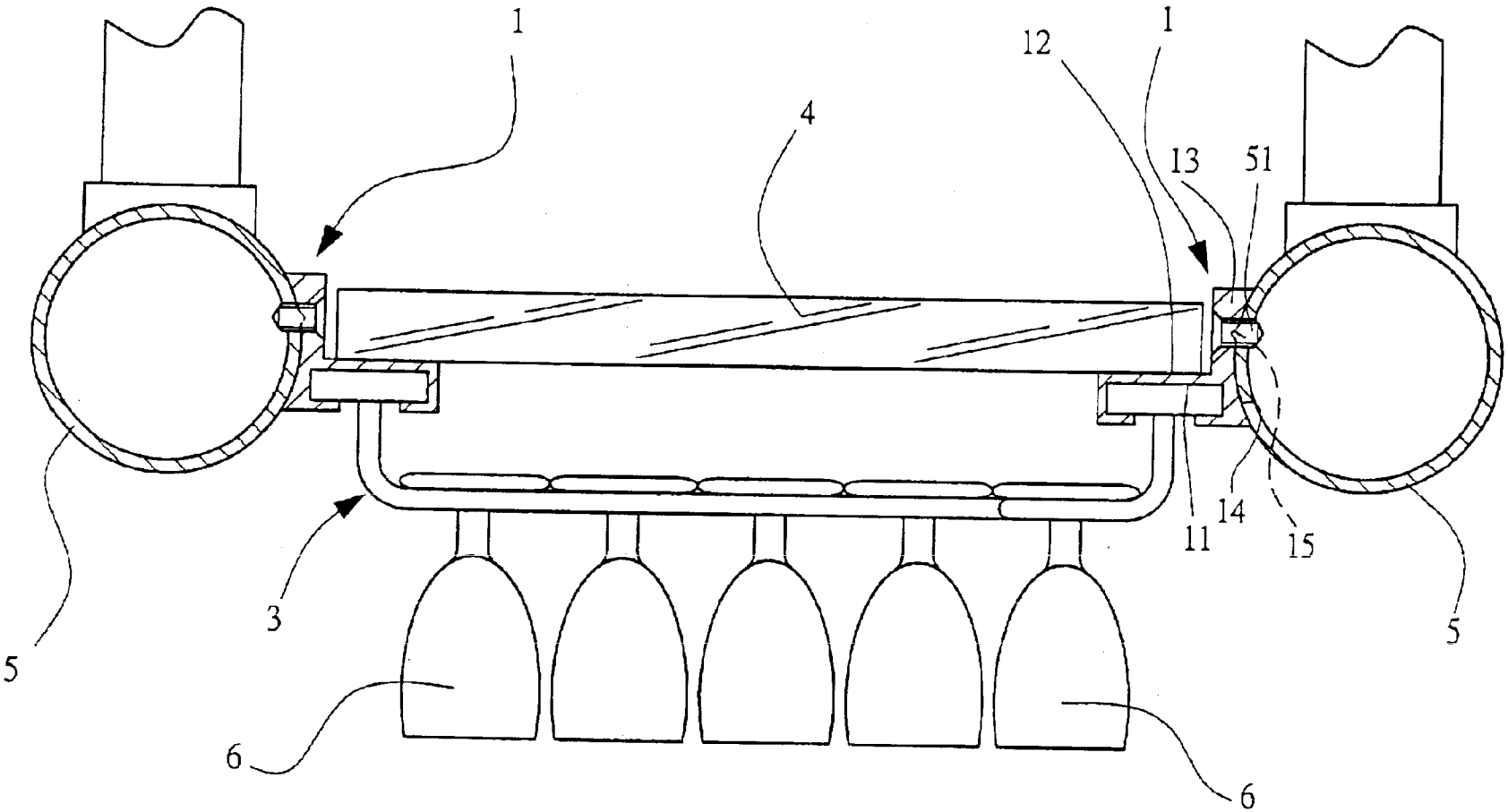
FIG. 4 a cross-sectional drawing of the present invention.

FIGS. 1, 2 and 4 show that the present invention of an improvement in a wine cup rack structure mainly comprises pluralities of copper rods (5) and pluralities of column caps (50) forming a frame body. There are supporting bars (1) to be respectively fixed on each side of the lowest two copper rods (5) for hangers (3) and a glass plate (4) to be assembled forming a whole rack body.

Figure 3:
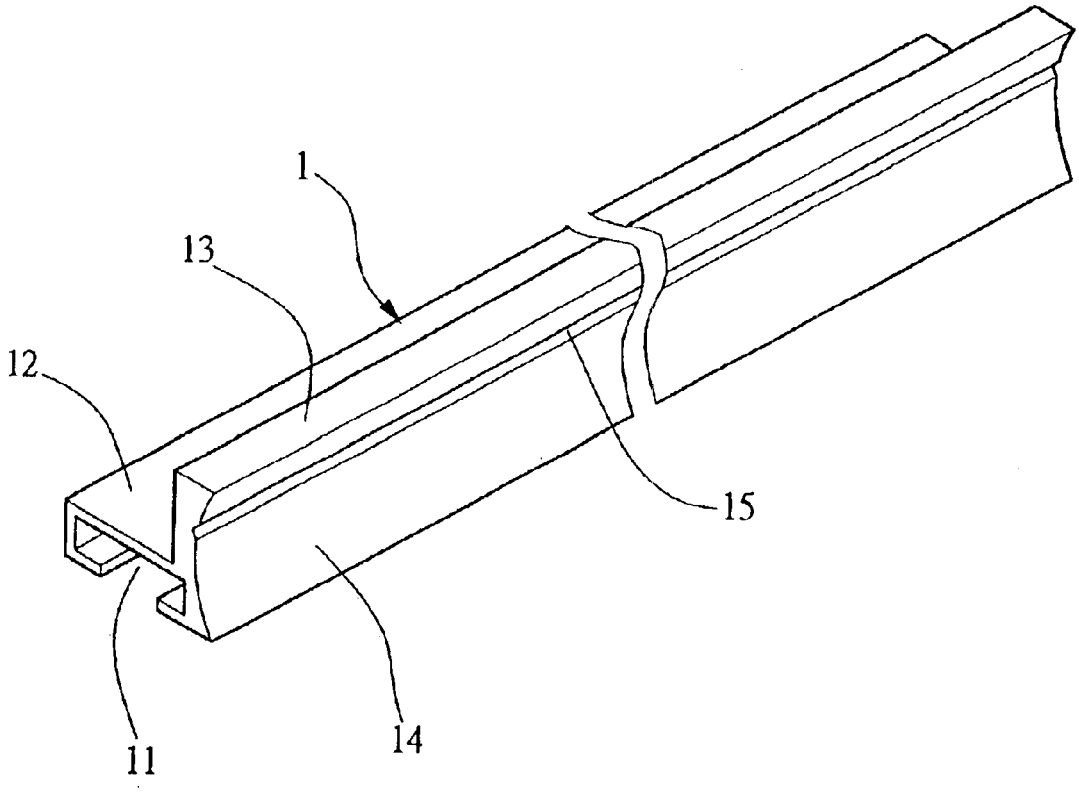
FIG. 3 is a structural drawing showing the supporting bars of the present invention.

As shown in FIGS. 2 and 3, a dovetail chute (11) with an opening downwards is installed below the supporting bar (1) for placing hangers (3) and the glass plate (4) is placed on the supporting bars (1). The supporting bars (1) set on one side of the chute (11) a side plate (13), which forms a camber surface (14) on the external side thereof. The camber surface (14) has a locating slot (15) along the axial direction. Moreover, there is no necessary to embed another fixed slot; instead, the glass plate (4) can be properly placed on the top surface (12) of both chutes (11) in-between the side plates (13).

Figure 5:
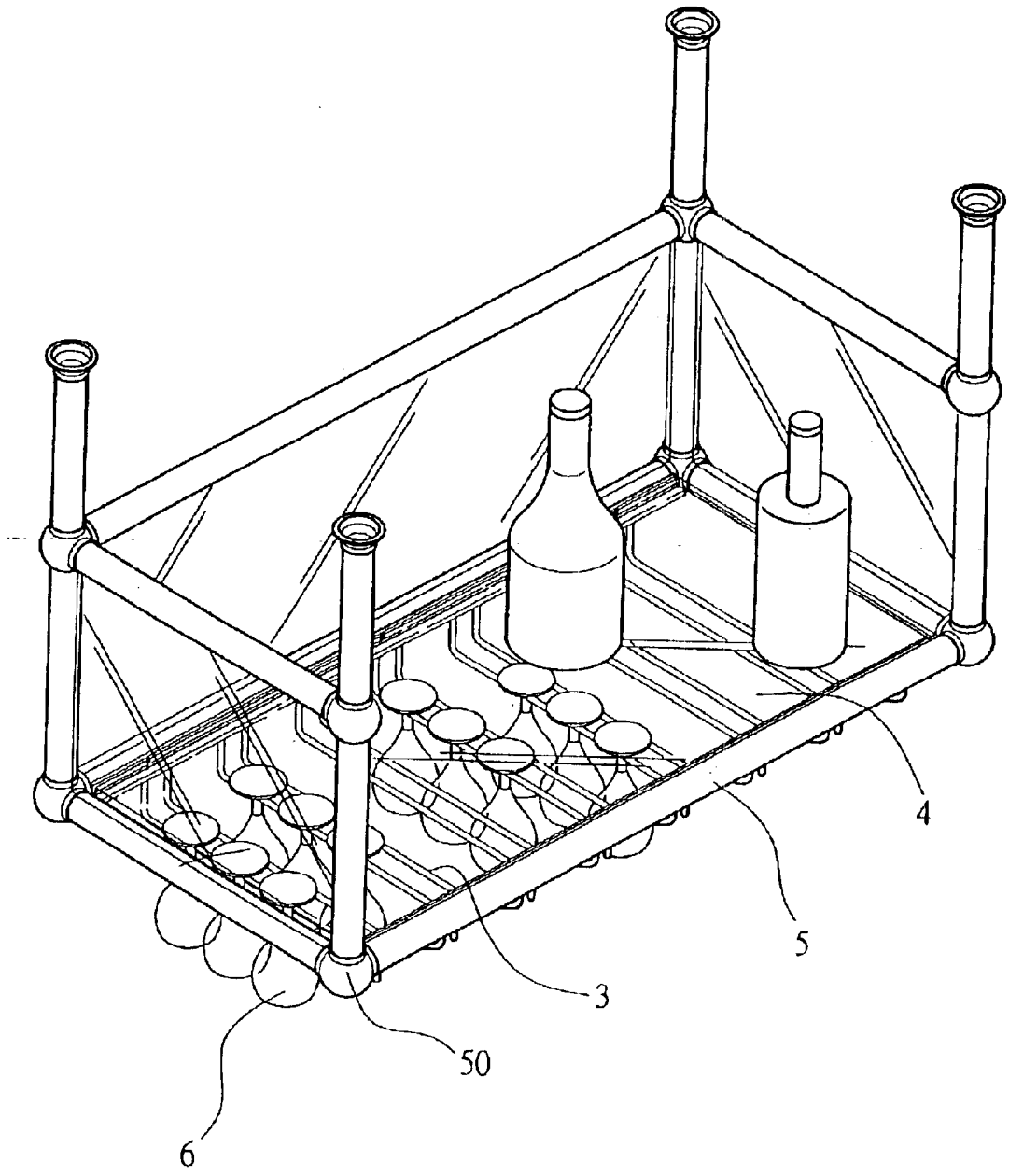
FIG. 5 is a perspective view showing the usage of the present invention.
Figure 6:
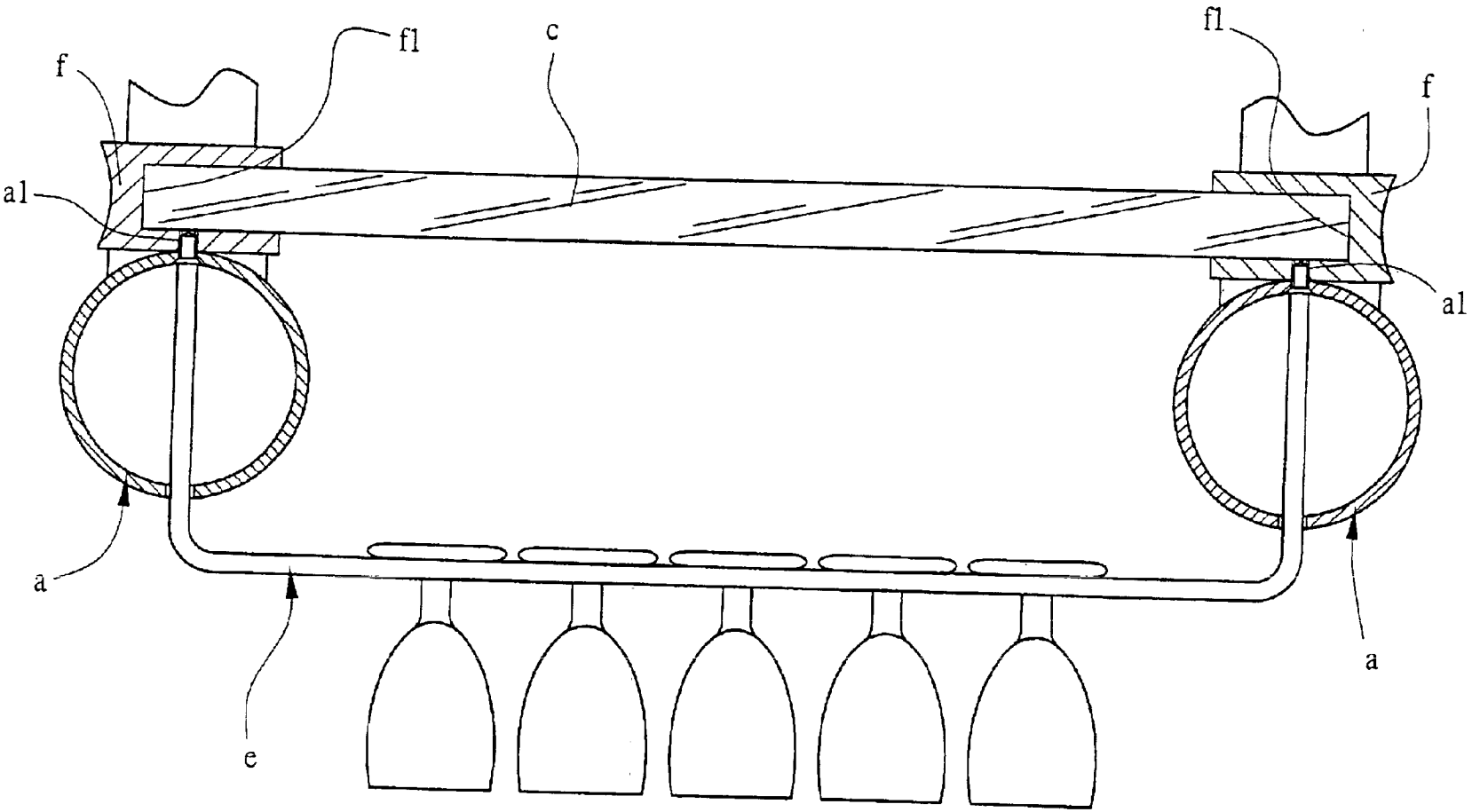
FIG.6 Prior Art
FIG. 6 is a perspective drawing with partial cross-sectional view by an overlook of presently known wine cup rack.
Figure 7:
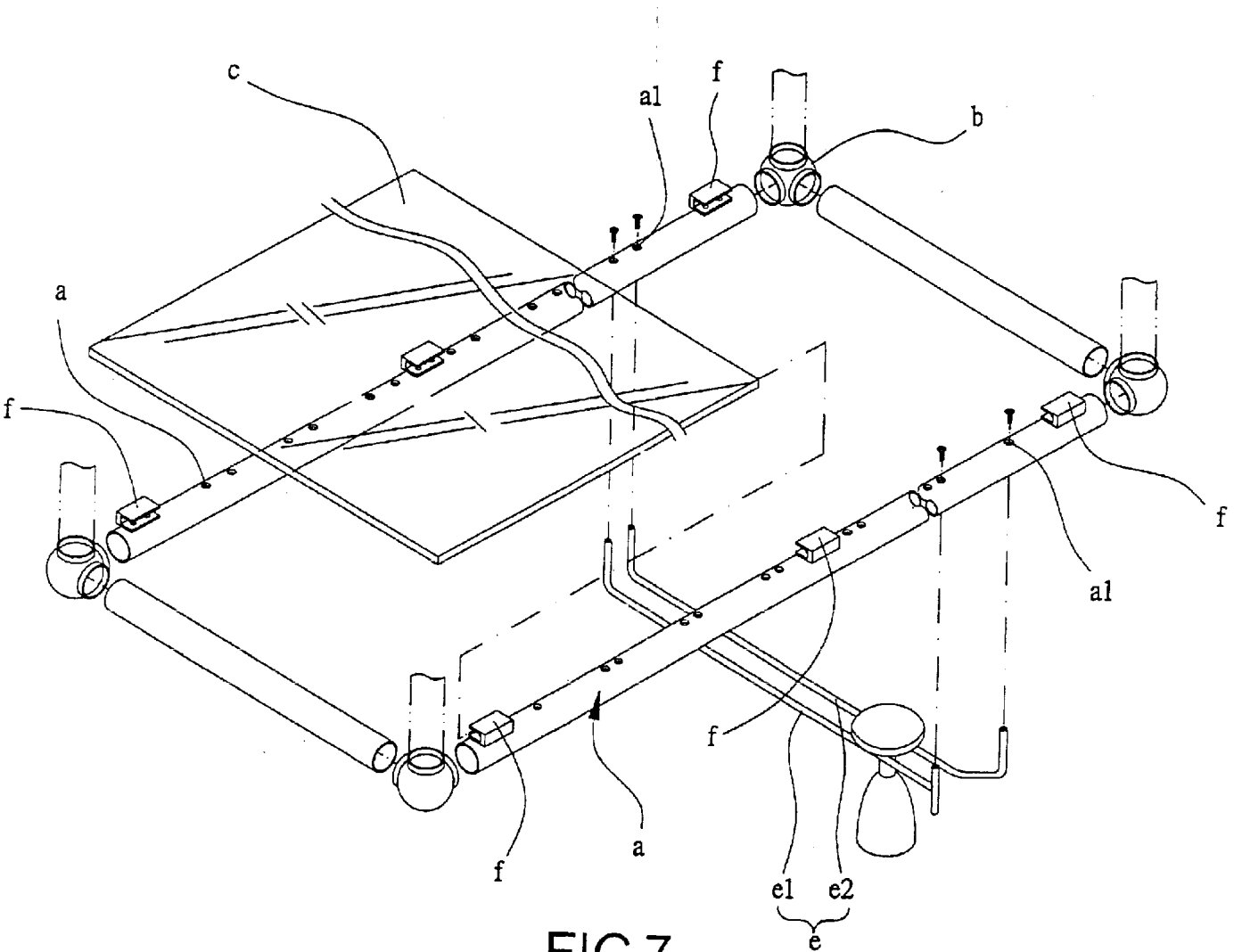
FIG.7 Prior Art
FIG. 7 is a perspective exploded view of presently known wine cup rack.
Figure 8:
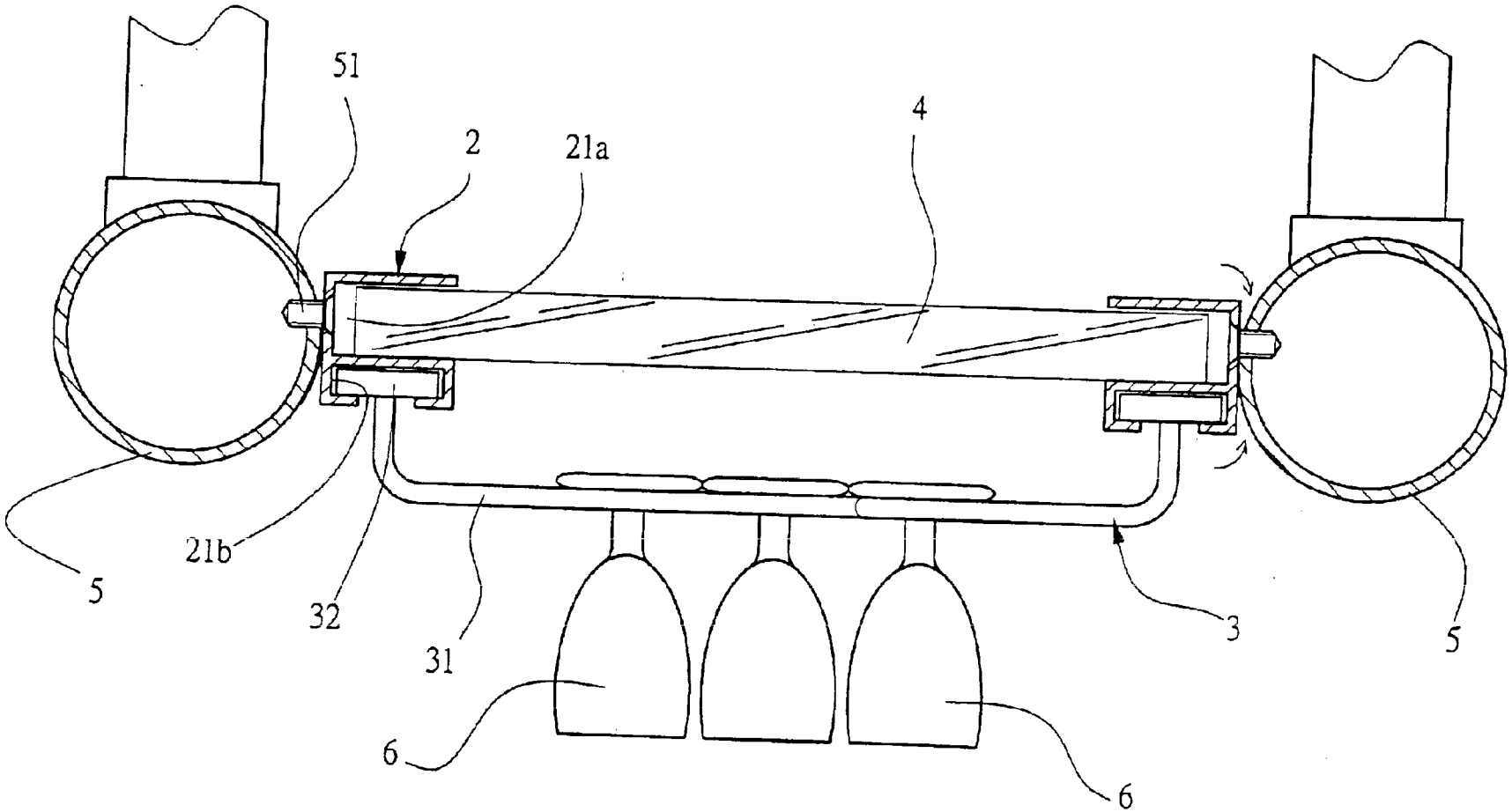
FIG.8 Prior Art
FIG. 8 is a perspective drawing with partial cross-sectional view by an overlook of presently known wine cup rack.
Figure 9:
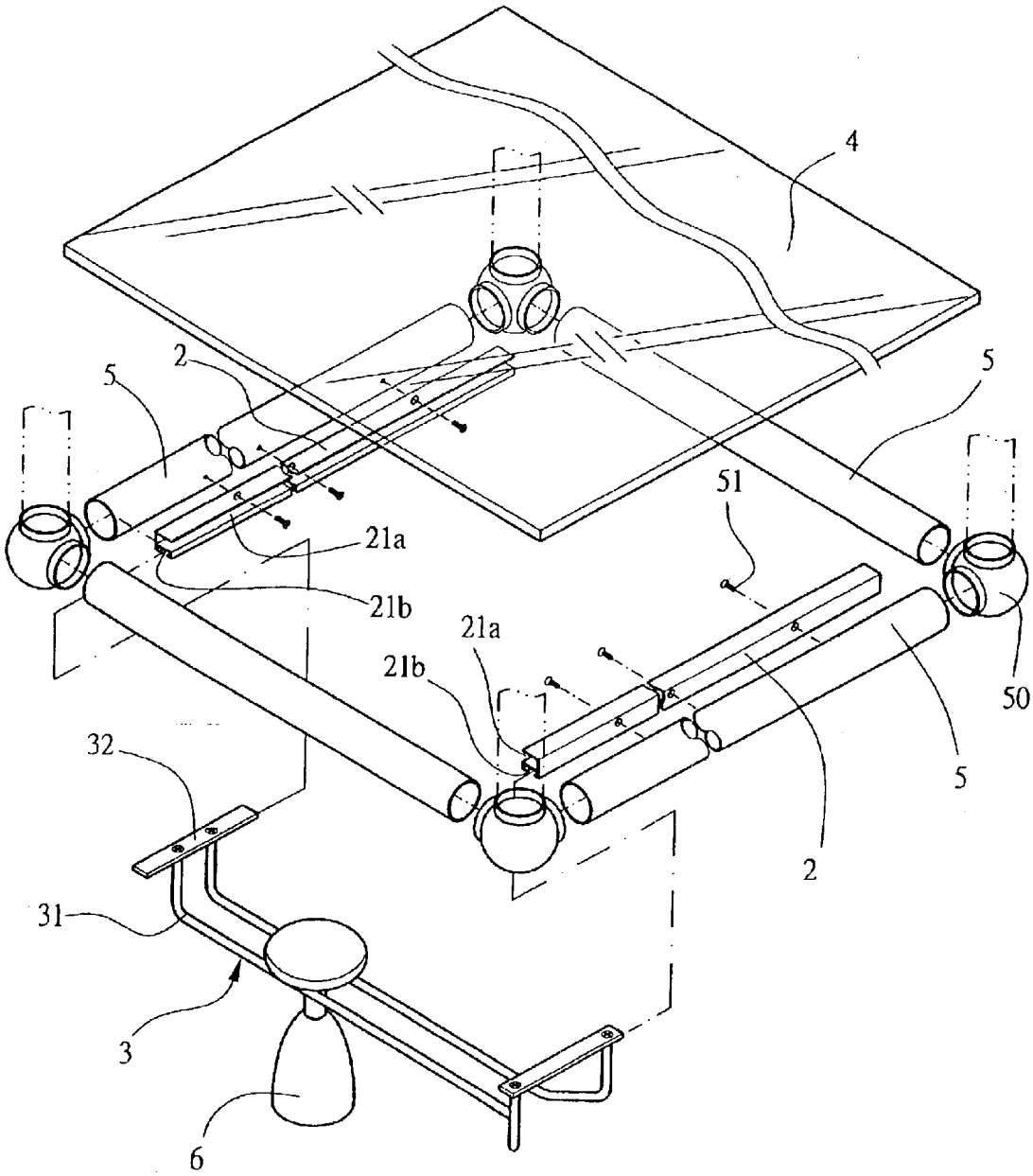
FIG.9 Prior Art
FIG. 9 is a perspective exploded view of presently known wine cup rack.

FIGS. 1, 4 and 5 show that the present invention of an improvement in a wine cup rack structure mainly comprises pluralities of horizontal and vertical copper rods (5), pluralities of column caps (50) and a glass plate (4) forming a frame body wherein a wine cellar for placing wine bottles is established on the above, and wine cups can be suspended upside down. As shown in FIGS. 2, 4 and 5, in-between two correspondent copper rods (5) sets two supporting bars (1), respectively. Each supporting bar (1) uses the camber surface (14) on the external side of the side plate (13) to appropriately lean against the cylindrical surface of each copper rod (5). The side plate (13) of the supporting bar (1) can be perforated in advance. Seeing that there is a locating slot (15) on the camber surface (14), the perforation work can be done at any position on the locating slot (15). Screws (51) can pierce through those aperture positions and further be fixed on the copper rods (5). In the meanwhile, there is a space within the top surfaces (12) of the chutes (11) and the side plates (13) of two supporting bars (1) for properly placing the glass plate (4) from the top downwards. The invention, therefore, makes it more convenient for installing the glass plate (4).

The invention further comprises the following advantages,

1. The supporting bar of the invention sets a side plate with a camber surface on one side to lean against the cylindrical surface of a copper rod of the wine cup rack, therefore, it is more appropriate and stable than the previous rack structure;
2. The side plate of the invention sets a concave and narrow locating slot for perforating apertures at any position, so that screws are able to pierce through those apertures and to be fixed on copper rods. The function of the invention make it more flexible and convenient than the previous rack structure;
3. There is a space formed in-between the top surface of the chute and the side of two supporting bars for properly placing a glass plate from the top downwards without another embedded slot established. The invention, therefore, not only simplifies the structure, but also saves materials for processing.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A wine cup rack structure comprising a plurality of horizontal and vertical copper rods, a plurality of column caps disposed at each end of each copper rod and connecting said copper rods, thereby forming a frame body;

a supporting bar fixed on a side of at least two of said horizontal copper rods, the lower portion of each supporting bar formed with a downwardly facing, elongated dovetail chute for supporting a plurality of hangers therein;

each supporting bar further including a side plate on an external side of said dovetail chute, an external side of said side plate formed with a camber or concave surface;

a plurality of screws fixing said horizontal copper rod to the camber or concave surface of said supporting bar;

whereby a glass plate may be placed on the top surface of said dovetail chute, and between said side plates of said supporting bars.

2. The wine cup rack of claim 1, wherein said camber or concave surface of each said external side of said side plate has an elongated locating slot formed along the length thereof.

* * * * *